US007603056B2

(12) United States Patent
Kamimura

(10) Patent No.: US 7,603,056 B2
(45) Date of Patent: Oct. 13, 2009

(54) IMAGE FORMING DEVICE

(75) Inventor: Naoya Kamimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 543 days.

(21) Appl. No.: 11/554,699

(22) Filed: Oct. 31, 2006

(65) Prior Publication Data

US 2007/0122186 A1 May 31, 2007

(30) Foreign Application Priority Data

Nov. 30, 2005 (JP) ..... 2005-346606

(51) Int. Cl.
*G03G 21/18* (2006.01)
*G03G 21/10* (2006.01)

(52) U.S. Cl. ..... 399/110; 399/123; 399/124; 399/125; 399/358; 399/359; 399/360

(58) Field of Classification Search ..... 399/101, 399/107, 110, 111, 121, 123, 124, 125, 358, 399/359, 360, 34, 35
See application file for complete search history.

(56) References Cited

U.S. PATENT DOCUMENTS 5,752,137 A * 5/1998 Haneda ..... 399/223
5,953,564 A 9/1999 Matsuzoe et al.
2006/0269316 A1 * 11/2006 Kyung et al. ..... 399/101

FOREIGN PATENT DOCUMENTS

| | | | |
|---|---|---|---|
| JP | H11095511 | A | 4/1999 |
| JP | 2005043594 | A | 2/2005 |
| JP | 2005134831 | A | 5/2005 |
| JP | 2005173295 | A | 6/2005 |

* cited by examiner

*Primary Examiner*—David M Gray
*Assistant Examiner*—G. M. Hyder
(74) *Attorney, Agent, or Firm*—Baker Botts L.L.P.

(57) ABSTRACT

An image forming device includes: a main unit case; a process unit; a belt unit; a belt; a belt cleaning unit; a storing unit; and a duct unit. The process unit is configured to be attached to and detached from the main unit case. The belt unit is configured to displace between an opposed position and an opened position. The belt unit in the opposed position is opposed to the process unit. The belt unit in the opened position allows the process unit to be exposed in the direction of removing the process unit from the main unit case. The belt is provided on the belt unit and is rotatingly driven. The belt cleaning unit is fixedly attached to the belt unit and removes material adhered to the belt. The storing unit is fixedly attached to the main unit case and stores therein the material removed from the belt by the belt cleaning unit. The duct unit has a conveying path in fluid communication with the belt cleaning unit and the storing unit. The duct unit conveys, along the conveying path, the material removed by the belt cleaning unit from the belt cleaning unit to the storing unit.

6 Claims, 13 Drawing Sheets

IMAGE FORMING DEVICE

CROSS REFERENCE TO RELATED APPLICATION

This application claims priority from Japanese Patent Application No. 2005-346606 filed Nov. 30, 2005, the entire content of which is incorporated herein by reference.

TECHNICAL FIELD

The disclosure relates to an image forming device.

BACKGROUND

Japanese Unexamined Patent Application Publication No. 2005-134831 has proposed an image forming device, which has a removing port, through which a developing unit can be removed from the image forming device. In the image forming device, a belt unit that is located as opposed to the developing unit is held by a cover (access door) for opening and closing the removing port. It is possible to improve efficiency of a replacing operation of the developing unit by removing the belt unit away from the developing unit by opening the cover.

More specifically, this device is a so-called intermediate transfer type color image forming device. A transfer medium storage box for storing sheets therein is disposed on the bottom of a housing of the image forming device. A plurality of image forming units are disposed above the transfer medium storage box. The plurality of image forming units are for a plurality of different developer colors (yellow, magenta, cyan and black), respectively. Each image forming unit has a photosensitive drum, an exposing unit, and a developing unit. These image forming units are stacked in a laminated manner in the order of yellow, magenta, cyan and black from below. An intermediate transfer member (belt unit) is disposed as opposed to each color photosensitive drum. Color developer images formed on the photosensitive drums are sequentially transferred to the intermediate transfer member. A multicolor image formed on the intermediate transfer member by superimposing toner images of each color is transferred on a sheet by a transfer mechanism, thereby forming a desired image on the sheet.

The intermediate transfer member is held by the access door. For this reason, the intermediate transfer member is usually opposed to the photosensitive drums. When the access door is opened, the intermediate transfer member is displaced together with the access door from its original position, and the space in front of the photosensitive drums is opened. By retreating the intermediate transfer member from the space in front of the photosensitive drums in this manner, the photosensitive drums are exposed to the outside. Accordingly, the photosensitive drums and the developing units can be easily taken out from the housing of the image forming device, thereby improving operability of replacement of the developing units and operability of maintenance work.

U.S. Pat. No. 5,953,564A has proposed an image display unit provided with a cleaning mechanism for cleaning a transfer belt. This device is configured so as to scrape off toner remaining on the transfer belt by use of a cleaning brush or a cleaning blade. The scraped remaining toner is conveyed by a toner conveying mechanism to a waste toner box.

SUMMARY

When toner, paper powder or the like is adhered on a belt for conveying a sheet or a developer image, quality of an image to be formed is deteriorated. To improve the quality of an image to be formed, it is desirable to apply the cleaning mechanism proposed by the above-described U.S. Pat. No. 5,953,564A to the image forming device proposed by the above-described Japanese Unexamined Patent Application Publication No. 2005-134831.

FIG. 1 illustrates a conceivable image forming device, in which a cleaning mechanism C1 and a waste toner box C2, which are provided in association with an intermediate transfer member 5, are provided in an internal space of an access door 11 together with the intermediate transfer member 5.

With the configuration in FIG. 1, however, the size of the movable part (the access door 11) becomes relatively large. As a result, a relatively large amount of force is required to open and close the access door 11 and thus, the operability of the access door 11 is deteriorated.

Furthermore, as the access door 11 increases in size, the thickness D also increases, which results in that a distance E between a front surface 2 of the image forming device and photosensitive drums 1 and developing units 4 increases. This requires efforts for detachment of the photosensitive drums 1 and developing units 4, resulting in deterioration of maintenance efficiency.

In view of the foregoing, it is an object of the invention to provide an image forming device which has a cleaning function of removing materials adhered on a belt, which can easily refill a developer, and which enables easy maintenance operation.

In order to attain the above and other objects, the invention provides an image forming device including: a main unit case; a process unit; a belt unit; a belt; a belt cleaning unit; a storing unit; and a duct unit. The process unit is configured to be attached to and detached from the main unit case. The belt unit is configured to displace between an opposed position and an opened position. The belt unit in the opposed position is opposed to the process unit. The belt unit in the opened position allows the process unit to be exposed in the direction of removing the process unit from the main unit case. The belt is provided on the belt unit and is rotatingly driven. The belt cleaning unit is fixedly attached to the belt unit and removes material adhered to the belt. The storing unit is fixedly attached to the main unit case and stores therein the material removed from the belt by the belt cleaning unit. The duct unit has a conveying path in fluid communication with the belt cleaning unit and the storing unit. The duct unit conveys, along the conveying path, the material removed by the belt cleaning unit from the belt cleaning unit to the storing unit.

BRIEF DESCRIPTION OF THE DRAWINGS

Illustrative aspects in accordance with the invention will be described in detail with reference to the following figures wherein.

DETAILED DESCRIPTION

Figure 1:
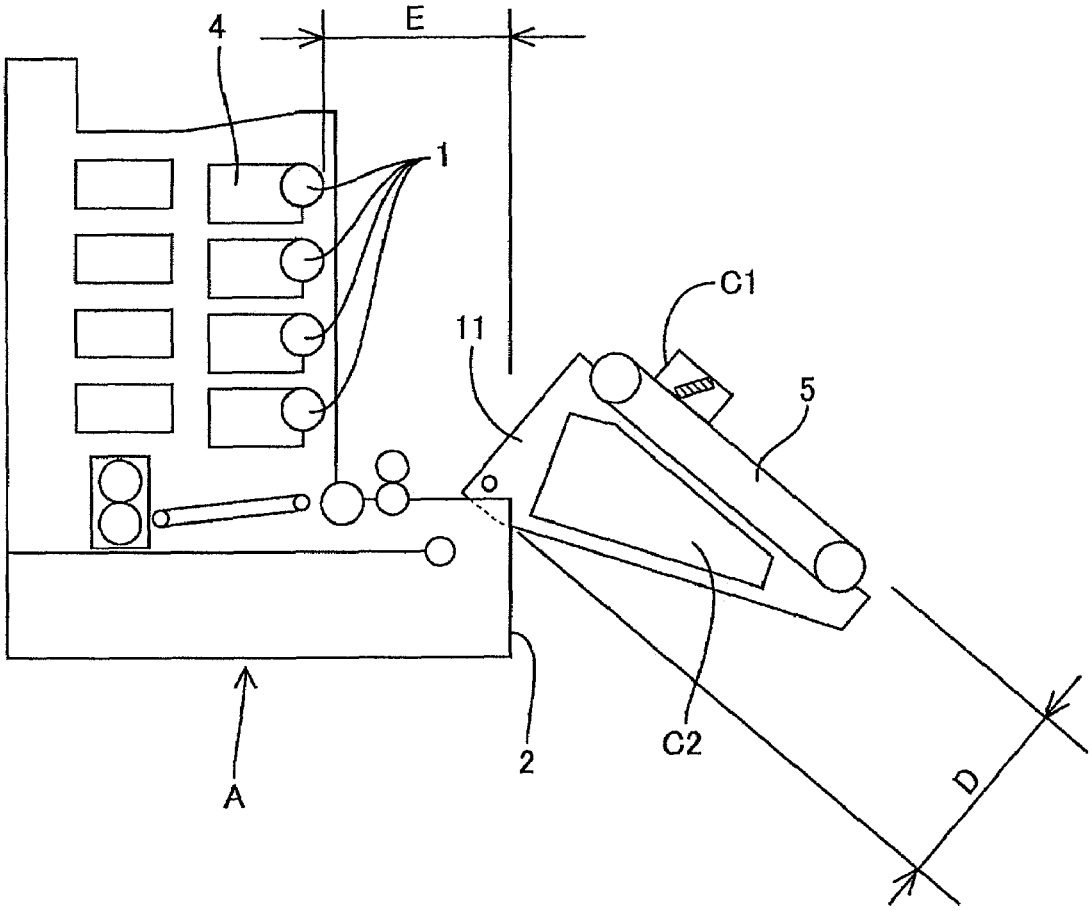
FIG. 1 illustrates a conceivable image forming device.

An image forming device according to some aspects of the invention will be described while referring to the accompanying drawings wherein like parts and components are designated by the same reference numerals to avoid duplicating description.

FIRST EMBODIMENT

A first embodiment will be described with reference to FIG. 2 to FIG. 6.

1. Overall Configuration

Figure 2:
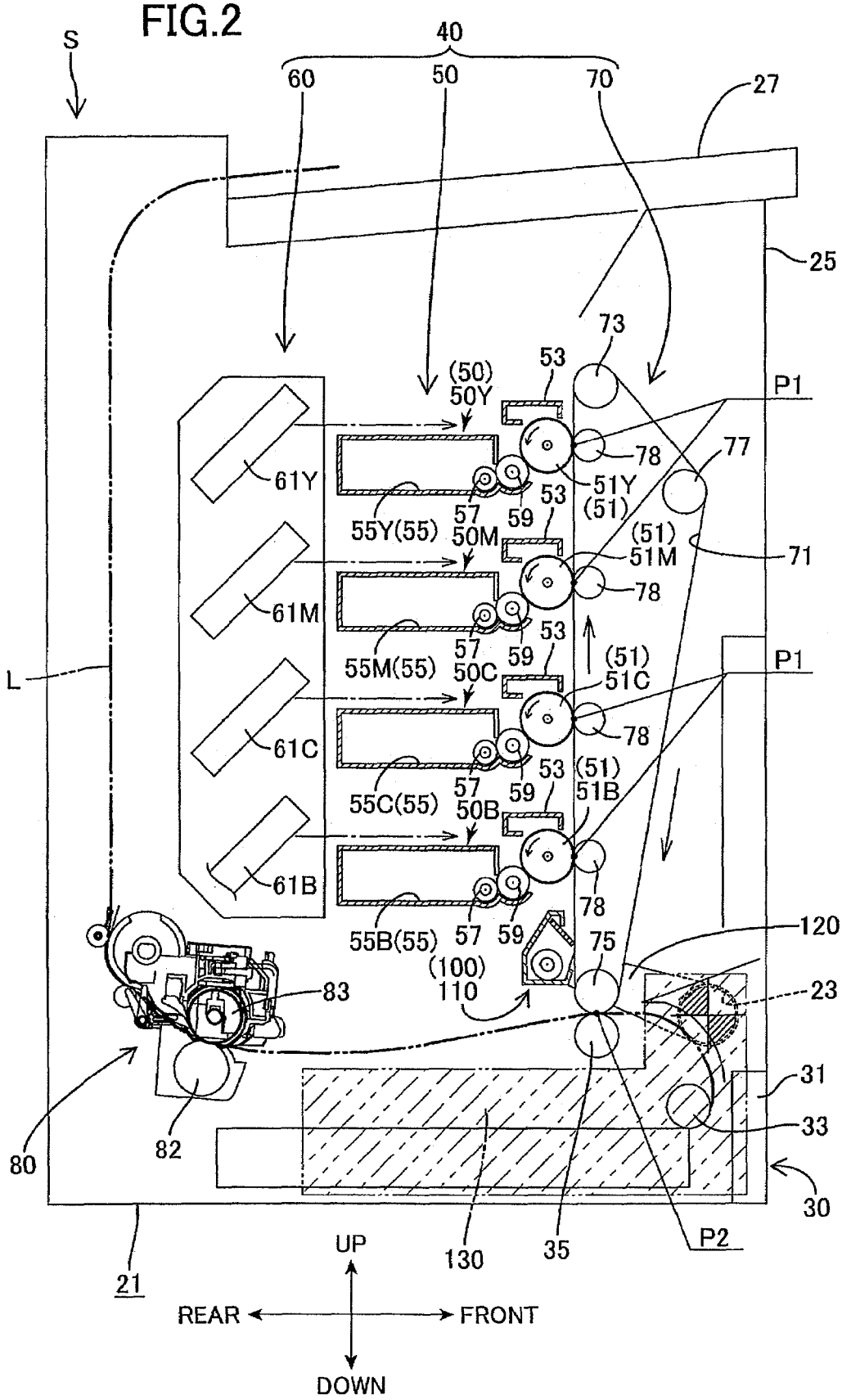
FIG. 2 is a side sectional view of a main part of a laser printer in accordance with a first embodiment of the invention.

FIG. 2 is a side sectional view of a main part of a laser printer S according to the first embodiment. The terms "upward", "downward", "upper", "lower", "above", "below", "beneath", "right", "left", "front", "rear" and the like will be used throughout the description assuming that the laser printer S is disposed in an orientation in which it is intended to be used. In use, the laser printer S is disposed as shown in FIG. 2.

The laser printer S is an intermediate transfer tandem type color laser printer. The laser printer S has a main unit case 21. A sheet feeding unit 30 is provided on the bottom of the main unit case 21, and a sheet conveying path L is formed above the sheet feeding unit 30.

The sheet conveying path L represented by a two-dotted chain line in FIG. 2 turns by about 180 degrees at the front upper part of the sheet feeding unit 30 and then, moves toward the rear part of the laser printer S. Next, the path L arrives the rear end of the laser printer S, turns upward to the upper part of the main unit case 21 and then, reaches a sheet output tray 27 provided on an upper wall of the main unit case 21. As described later in detail, a developer image (toner image) is transferred onto a sheet supplied from the sheet feeding unit 30 while the sheet is being conveyed along the sheet conveying path L, and then the image transferred on the sheet is thermally fixed by a fixing unit 80 to form a desired image on the sheet.

2. Configuration of Each Part

The laser printer S has the sheet feeding unit 30, an image forming part 40, the fixing unit 80 and a cleaning mechanism 100. The sheet feeding unit 30 has a feeding cassette 31 and a sheet feeding roller 33. The feeding cassette 31 stores sheets (recording media) therein, and the sheet feeding roller 33 picks the sheets one at a time and sends it to the sheet conveying path L.

The image forming part 40 has process units 50B, 50C, 50M, and 50Y (which will be collectively refer-red to as process units 50), a scanner unit 60 and an intermediate transfer belt unit 70. The process units 50 are located nearly at the center in the front-to-rear direction of the main unit case 21. The process units 50B, 50C, 50M, and 50Y are in one-to-one correspondence with four colors (black, cyan, magenta and yellow). The process units 50B, 50C, 50M, and 50Y have toner boxes 55B, 55C, 55M and 55Y (which will be collectively referred to as toner boxes 55), respectively. Each toner box 55B, 55C, 55M or 55Y is laid to extend horizontally. The four toner boxes 55B, 55C, 55M and 55Y are stacked one on another in the vertical direction. Each process unit 50 further has a feeding roller 57 and a developing roller 59, which are provided on the front end of a corresponding toner box 55 as opposed to one another. The process units 50B, 50C, 50M, and 50Y further have photosensitive drums 51B, 51C, 51M, and 51Y (which will be collectively referred to as photosensitive drums 51), respectively. Each photosensitive drum 51 is disposed in front of a corresponding developing roller 59. A charger 53 is disposed above each photosensitive drum 51, and serves to positively charge the surface of the photosensitive drum 51 uniformly.

The scanner unit 60 is located in the rear of the process units 50. The scanner unit 60 has four scanner parts 61B, 61C, 61M and 61Y corresponding to the four photosensitive drums 51B, 51C, 51M and 51Y. Each scanner part 61 has a laser light source, a polygon mirror, an fθ lens and reflecting mirrors (not shown), and serves to irradiate a laser beam emitted from the laser light source to the surface of a corresponding photosensitive drum 51 through a path represented by a chain line in FIG. 2.

The intermediate transfer belt unit 70 has three rollers of a driving roller 73, a backup roller 75 and a tension roller 77. An endless intermediate transfer belt 71 is wound around these three rollers 73, 75 and 77. The intermediate transfer belt unit 70 is disposed in front of the process units 50, and is elongated vertically. Specifically, the intermediate transfer belt unit 70 is disposed with the backup roller 75 being located at the bottom, the driving roller 73 being located at the top. A conveyance surface of the intermediate transfer belt 71 for conveying toner images thereon faces rearwardly and is in contact with the photosensitive drums 51B, 51C, 51M and 51Y.

The intermediate transfer belt 71 is made of a resin material, such as polycarbonate, for example, and has a width greater than or equal to the largest sheet size (for example, A4 size) that is printable by the laser printer S. When a driving force is transmitted from a motor (not shown) to the driving roller 73, the driving roller 73 starts rotating. By the rotation of the driving roller 73, the intermediate transfer belt 71 circulates in the direction of an arrow in FIG. 2.

Transfer rollers 78 are disposed as opposed to the photosensitive drums 51B, 51C, 51M and 51Y, respectively, across the intermediate transfer belt 71. A secondary transfer roller 35 is disposed below the backup roller 75 across the intermediate transfer belt 71. A belt cleaning unit 110 forming a part of the cleaning mechanism 100 to be described later is provided to the upper rear side of the backup roller 75. The intermediate transfer belt unit 70 is held by a front cover 25 by a fixing mechanism (not shown).

The fixing unit 80 is provided to the rear of the sheet feeding unit 30. The fixing unit 80 has a heating roller 83 and a pressing roller 82 disposed as opposed to the heating roller 83. The heating roller 83 has a halogen lamp (not shown) for heating. A multicolor toner image transferred on the sheet by the transfer roller 35 is thermally fixed on the sheet while the sheet passes between the heating roller 83 and the pressing roller 82.

Next, a series of image forming operations will be briefly described.

First, the surfaces of the photosensitive drums 51B, 51C, 51M and 51Y are positively charged uniformly by the chargers 53 while being rotated. Thereafter, when image data is input from a host device, for example, to the laser printer S, control based on the image data is started and a laser beam is irradiated from each of the scanner parts 61B to 61Y toward a corresponding photosensitive drum 51B to 51Y. Thus, electrostatic latent images corresponding to the image data are formed on the surfaces of the photosensitive drums 51B, 51C, 51M and 51Y. That is, the potential of laser-irradiated areas on the surfaces of the photosensitive drums 51B, 51C, 51M and 51Y that have been positively charged uniformly is lowered.

Next, with rotation of the developing rollers 59, positively-charged toner which is carried on the developing rollers 59 is fed to the electrostatic latent images formed on the surfaces of the photosensitive drums 51B, 51C, 51M and 51Y. Thus, the electrostatic latent images on the photosensitive drums 51B, 51C, 51M and 51Y are developed by reverse development, and the thus developed visible toner images are carried on the surfaces of the photosensitive drums 51B, 51C, 51M and 51Y.

While the above-mentioned processing of forming the toner images is being executed, power is transmitted from the main motor (not shown) to the driving roller 73, thereby circulatingly driving the intermediate transfer belt 71. Accordingly, when toner images carried on the surfaces of the photosensitive drums 51B, 51C, 51M and 51Y reach transfer positions P1 (positions at which the photosensitive drums 51B, 51C, 51M and 51Y are in contact with the transfer rollers 78 via the intermediate transfer belt 71), the toner images are transferred on the intermediate transfer belt 71. This transfer is sequentially performed in the order of black, cyan, magenta and yellow and the toner images are transferred to be superimposed on the intermediate transfer belt 71.

By rotation of the sheet feeding roller 33, sheets are sent one at a time from the feeding cassette 31 to the sheet conveying path L at predetermined timings. One sheet sent to the sheet conveying path L is sent to a secondary transfer position P2 (a position at which the transfer roller 35 is in contact with the backup roller 75 via the intermediate transfer belt 71).

When the sheet passes the secondary transfer position P2, a multicolor image formed by superimposing the toner images of all the colors on the surface of the intermediate transfer belt 71 is transferred on the sheet due to a transfer bias applied to the secondary transfer roller 35. Then, the sheet passes the fixing unit 80, where the transferred toner image (multicolor image) is thermally fixed on the sheet. The sheet is then finally discharged on the sheet output tray 27.

Figure 3:
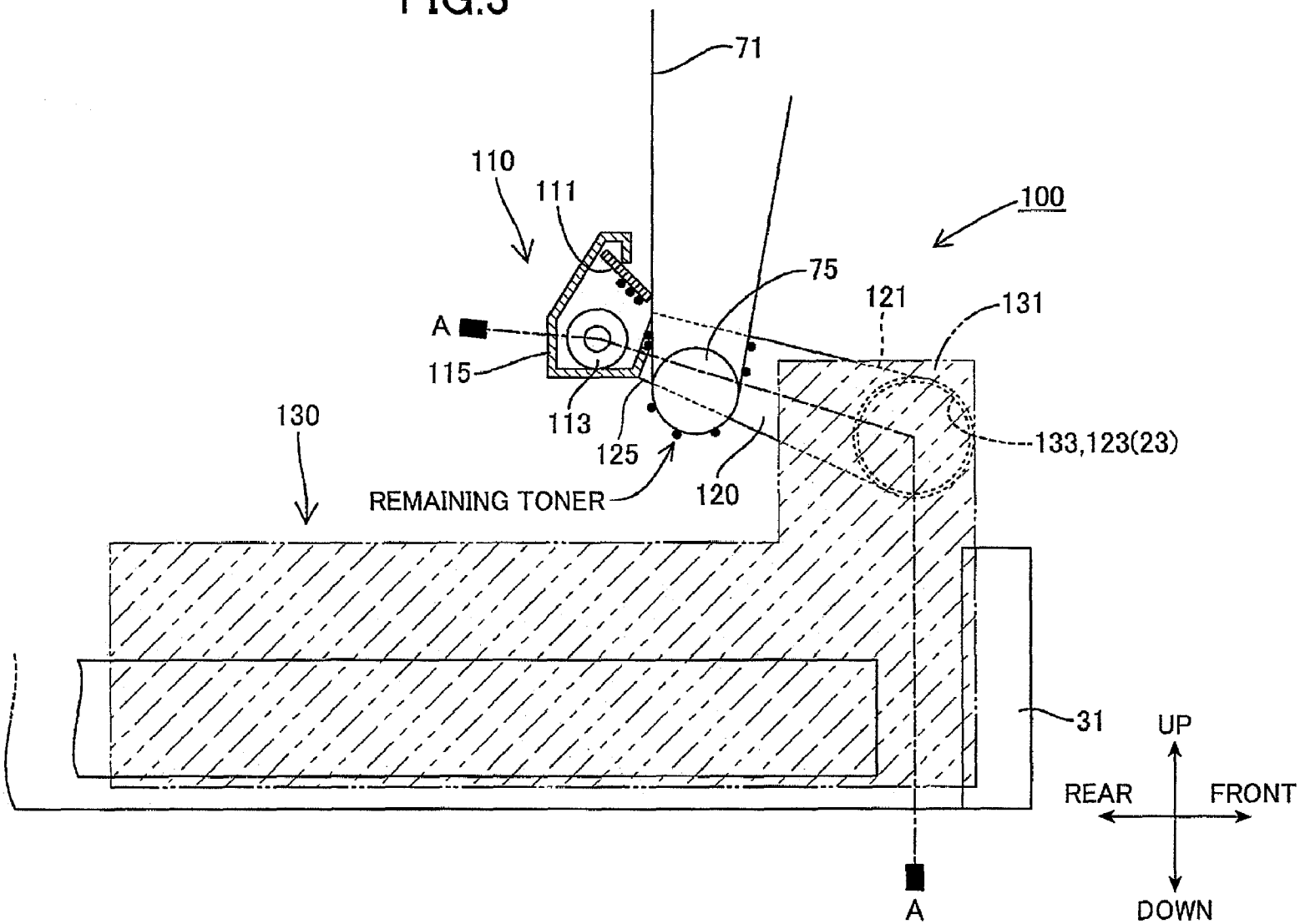
FIG. 3 is a side view showing schematic configuration of a cleaning mechanism provided in the laser printer of FIG. 2.
Figure 4:
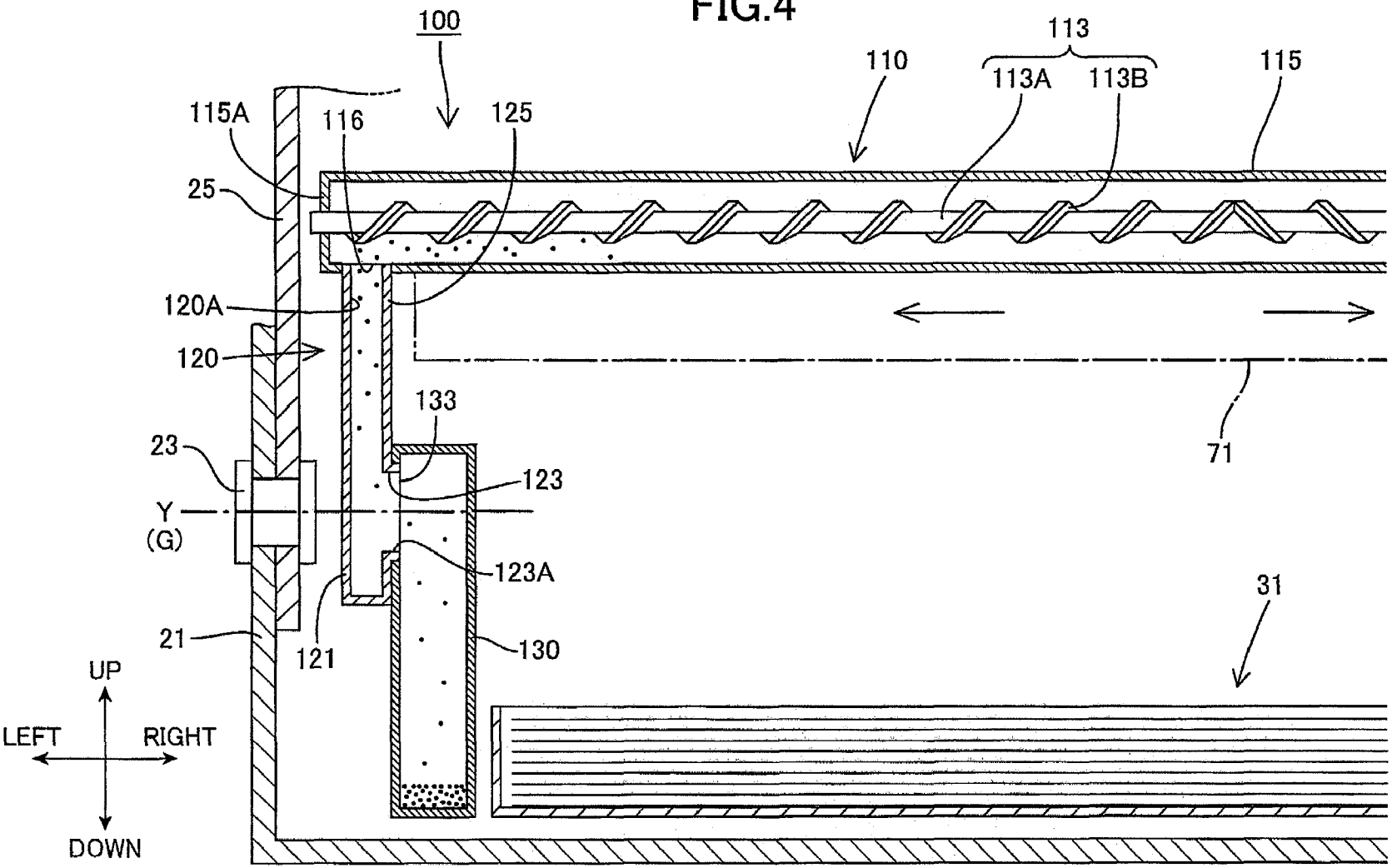
FIG. 4 is a sectional view taken along a line A-A in FIG. 3.

Next, the cleaning mechanism 100 will be described. FIG. 3 is a side view showing schematic configuration of the cleaning mechanism and FIG. 4 is a sectional view taken along a line A-A in FIG. 3. Since the cleaning mechanism 100 is symmetrical with respect to its center in the right-to-left direction, only a left half is shown in FIG. 4 and a right half is omitted.

The cleaning mechanism 100 has: the belt cleaning unit 110, a pair of duct units 120 (right-side and left-side duct units 120), and a pair of waste toner boxes 130 (right-side and left-side waste toner boxes 130). The cleaning mechanism 100 serves to remove material adhered on the conveyance surface (transfer surface) of the intermediate transfer belt 71 (mainly toner remaining on the intermediate transfer belt 71 after secondary transfer). Of the right-side and left-side duct units 120 and right-side and left-side waste toner boxes 130, only the left-side duct unit 120 and the left-side waste toner box 130 are shown in FIG. 4.

As shown in FIG. 3, the belt cleaning unit 110 has a cleaning box 115. A scraping blade 111 and an auger 113 are mounted in the cleaning box 115. The cleaning box 115 is elongated in the width direction of the intermediate transfer belt 71 (right-to-left direction of the laser printer S). The cleaning box 115 is partly opened to have a cross-section substantially in the form of a character C.

The scraping blade 111 is made of a resin material such as polyurethane elastomer and is elongated in the width direction of the intermediate transfer belt 71 (right-to-left direction of the laser printer S). The scraping blade 111 is fixed to the cleaning box 115. The tip end of the scraping blade 111 protrudes outwardly from the opening of the cleaning box 115.

The cleaning box 115 is fixedly attached to the intermediate transfer belt unit 70 in the state where the opening of the cleaning box 115 faces the surface of the intermediate transfer belt 71 and the tip end of the scraping blade 111 is in contact with the surface of the intermediate transfer belt 71. With such a configuration, as shown in FIG. 3, the toner remaining on the intermediate transfer belt 71 is scraped off by the scraping blade 111 and the scraped toner is stored in the cleaning box 115.

As shown in FIG. 4, the auger 113 has: a shaft 113A that extends in the longitudinal direction of the cleaning box 115 (right-to-left direction of the laser printer S); and a spiral blade 13B that is formed on the periphery of the shaft 113A. The auger 113 is supported in the cleaning box 115. More specifically, right-side and left-side ends of the shaft 113A are inserted through through-holes formed in the right and left side walls of the cleaning box 115, respectively. A driving force of the main motor (not shown) is transmitted to the shaft 113A, and the auger 113 is rotatingly driven by the driving force.

The toner stored in the cleaning box 115 is forcibly sent to both of the right-side and left-side edges of the cleaning box 115. Specifically, the spiral direction of the spiral blade 113B is reversed at the longitudinal center (center in the right-to-left direction) of the shaft 113A. For this reason, of the toner scraped off by the scraping blade 111, a part of the toner located on the left side of the longitudinal center is forcibly sent to the left end of the cleaning box 115 and another part of the toner located on the right side of the longitudinal center is forcibly sent to the right end of the cleaning box 115 by the auger 113.

Next, the waste toner boxes 130 which store the removed toner therein will be described. Each waste toner box 130 is shaped like a rectangular parallelepiped extending in the front-to-rear direction of the laser printer S as shown in FIG. 3, and is located on the bottom of the main unit case 21 at a location next to the feeding cassette 31 in the width direction (right-to-left direction) of the laser printer S as shown in FIG. 4. More specifically, the feeding cassette 31 is disposed at the center in the width direction (right-to-left direction) of the laser printer S, and the right-side and left-side waste toner boxes 130 are disposed at the right and left sides, respectively, of the feeding cassette 31, although only the left-side waste toner box 130 is shown in this figure. The waste toner boxes 130 are fixedly attached to the main unit case 21 by the fixing mechanism (not shown).

The waste toner boxes 130 are thus disposed in a so-called dead space in the main unit case 21. This contributes to reduction in size of the laser printer S.

As shown in FIG. 3, each waste toner box 130 has a protruding part 131 at its front side. The protruding part 131 protrudes upwardly. The protruding part 131 functions as a duct connecting part. As shown in FIG. 3 and FIG. 4, a circular toner receiving port 133 is opened on the left-side wall of the protruding part 131.

Each duct unit 120 connects the belt cleaning unit 110 to the corresponding waste toner box 130, and has a passage 120A for conveying toner therealong. As shown in FIG. 3, the duct unit 120 has an arm-shaped cross section which is tapered from its base end 121 toward its tip end 125. The duct unit 120 is connected to the waste toner box 130 at its base end 121, and is connected to the belt cleaning unit 110 at its tip end 125.

As shown in FIG. 3 and FIG. 4, a circular toner exit 123 (circular-shaped inserting opening) is formed on the right side wall of the base end 121 of the duct unit 120. As shown in FIG. 4, an annular projection 123A is formed on the edge of the circular toner exit 123 and protrudes rightwardly. The annular projection 123A is fitted into the circular toner receiving port 133 of the waste toner box 130 with no gaps therebetween. In this manner, the base end 121 of the duct unit 120 is coupled to the waste toner box 130.

A connecting through-hole 116 is formed on each of the right-side and left-side ends of the belt cleaning unit 110 at its lower surface, although FIG. 4 shows only the one connecting through-hole 116 that is formed on the left-side end of the belt cleaning unit 110. The tip end 125 of the duct unit 120 is fitted into the connecting through-hole 116 with no gaps therebetween. In this manner, the tip end of the duct unit 120 is connected to the belt cleaning unit 110. The duct unit 120 is closed except for the circular toner exit 123 and the connecting through-hole 116. This ensures that toner will not scatter to the outside of the duct unit 120.

As described above, the belt cleaning unit 110 is connected to the waste toner boxes 130 via the duct units 120 in a sealed manner. Thus, as shown in FIG. 4, toner is forcibly sent to both ends of the cleaning box 115 by the auger 113, then moves into the duct units 120 through the connecting through-holes 116, and then finally moves into the waste toner boxes 130 through the passages 120A of the duct units 120. In this manner, toner is stored in the waste toner boxes 130.

Because the duct unit 120 is connected to the waste toner box 130 in the above-described manner, the duct unit 120 can freely rotate, with the outer peripheral surface of the annular projection 123A being in sliding contact with the inner peripheral surface of the circular toner receiving port 133.

Thus, the duct unit 120 can rotate about the circular toner receiving port 133. For this reason, there is no need to provide an additional mechanism that is dedicated to rotating the duct unit 120, and the configuration becomes simple.

As shown in FIG. 4, each waste toner box 130 is provided in the main unit case 21, with the central axis of the circular toner receiving port 133 being in alignment with a rotational axis Y of the front cover 25, that is, the rotational center of a hinge 23 to be described later. The central axis of the circular toner receiving port 133 serves as the rotational axis G of the duct unit 120. The duct unit 120 can freely rotate around its rotational axis G. Accordingly, the duct unit 120 can freely rotate around the rotational axis Y of the front cover 25.

3. Attachment/Detachment Configuration of Process Unit 50

Next, attachment/detachment configuration of the process unit 50 will be described with reference to FIG. 5 and FIG. 6.

Figure 5:
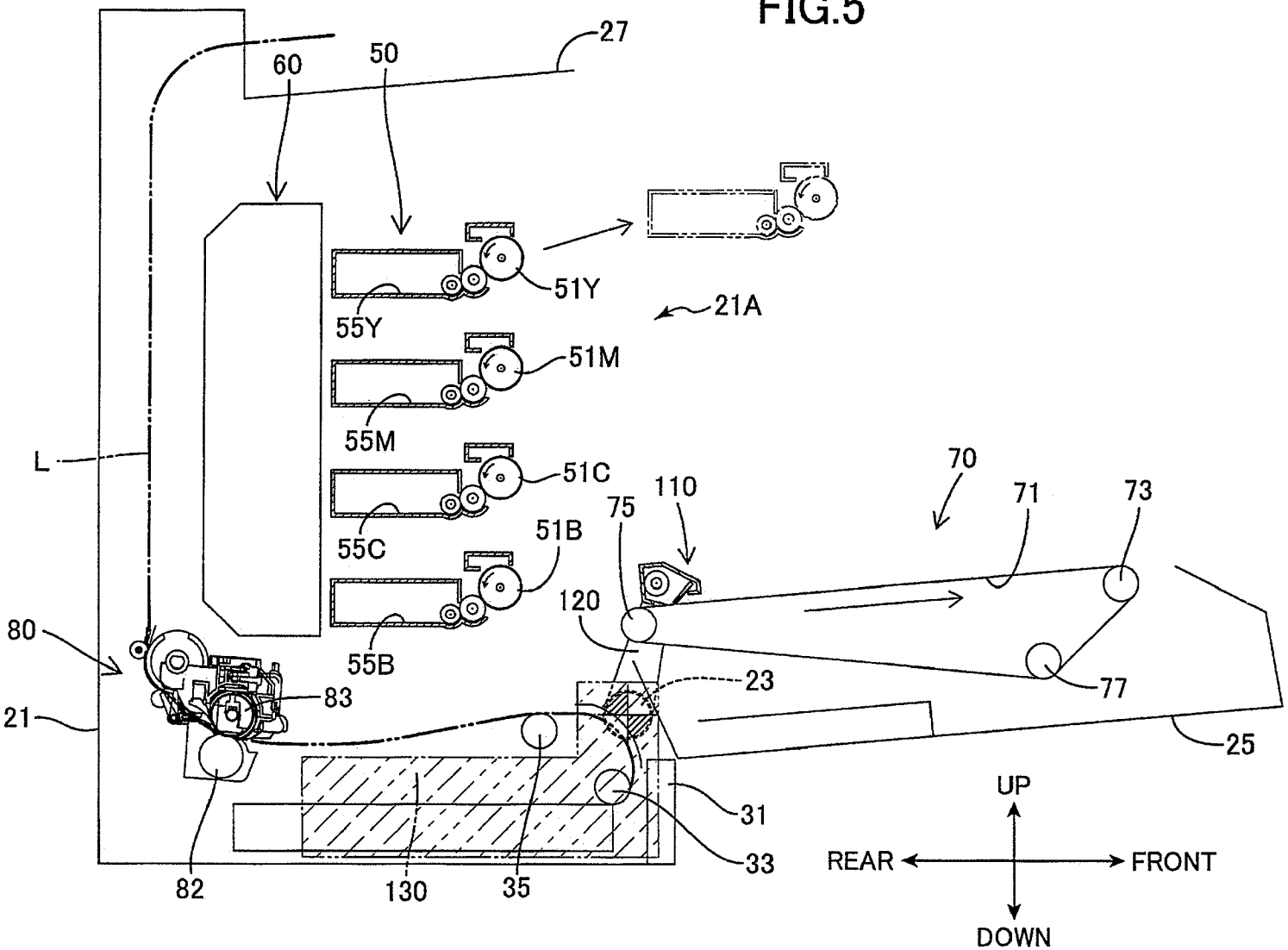
FIG. 5 is an illustration showing the state in which a front cover is opened to remove a process unit from the laser printer.
Figure 6:
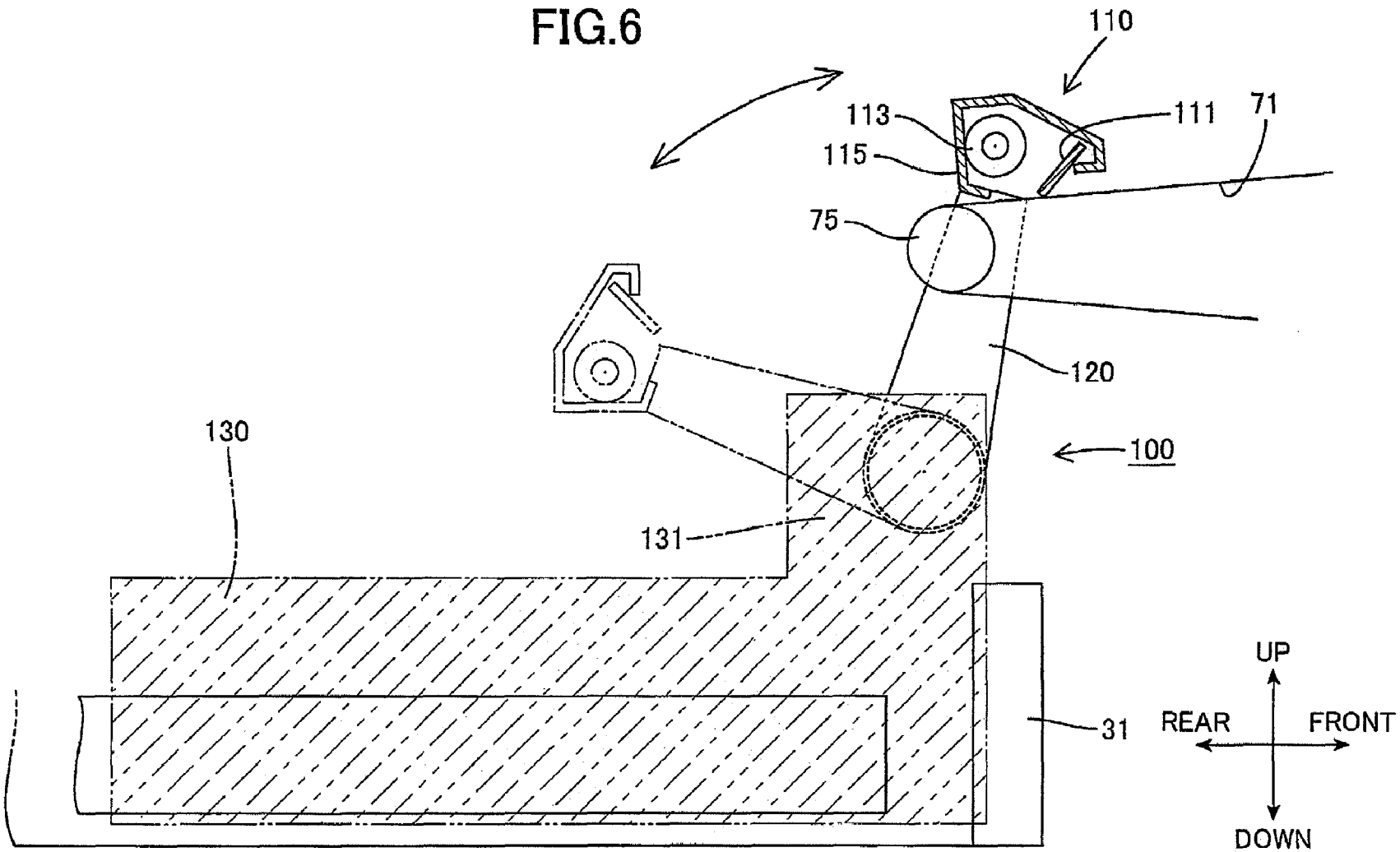
FIG. 6 illustrates a rotating operation of a duct unit.

As shown in FIG. 5, the front surface of the main unit case 21 is formed with a process unit removing port (opening) 21A, and the front cover 25 is attached to the front surface of the main unit case 21 to open and close the process unit removing port 21A. The front cover 25 is coupled to the main unit case 21 by the hinge 23, which is provided on the front end of the lower portion of the main unit case 21. Accordingly, the front cover 25 can move between a closed state, in which the front cover 25 closes the front surface of the main unit case 21 (process unit removing port 21A) as shown in FIG. 2, and an opened state in which the front cover 25 opens the front surface of the main unit case 21 (process unit removing port 21A) as shown in FIG. 5. When the front cover 25 is in the closed state, as shown in FIG. 2, the intermediate transfer belt 71 is opposed to the process units 50. When the front cover 25 is opened, the intermediate transfer belt 71 rotates together with the front cover 25 and moves away from the process units 50 to open the space in front of the process units 50. The process units 50 are configured to be attached to and detached from the main unit case 21 of the laser printer S through the process unit removing port 21A. Accordingly, when the space in front of the process units 50 is thus opened and the process units 50 are exposed outside through the process unit removing port 21A, the process units 50 can be removed individually from the laser printer S.

Since the belt cleaning unit 110 is fixed to the intermediate transfer belt unit 70 as described above, when the front cover 25 is opened and the intermediate transfer belt 71 is retreated from the opposed position (FIG. 2) to the opened position (FIG. 5), the belt cleaning unit 110 rotates together with the intermediate transfer belt unit 70. If the duct units 120 could not follow the motion of the intermediate transfer belt unit 70, the duct units 120 will detach from the belt cleaning unit 110 or the waste toner boxes 130. As a result, toner in the belt cleaning unit 110 or the waste toner box 130 will scatter into the main unit case 21.

Contrarily, according to the present embodiment, each duct unit 120 can freely rotate around the rotational axis Y of the front cover 25, with the outer peripheral surface of the annular projection 123A being in sliding contact with the inner peripheral surface of the circular toner receiving port 133. Accordingly, when the intermediate transfer belt unit 70 retreats (displaces) from the opposed position to the opened position, the duct units 120 also smoothly rotate together with the intermediate transfer belt unit 70. The duct units 120 can follow the motion of the intermediate transfer belt unit 70. For this reason, while the intermediate transfer belt unit 70 rotates, connection between the waste toner boxes 130 and the belt cleaning unit 110 via the duct units 120 is maintained. That is, the sealing performance of the paths for conveying toner from the cleaning part 110 through the duct units 120 to the waste toner boxes 130 is maintained. Toner will never scatter in the device.

In this embodiment, the waste toner boxes 130 for storing toner therein are fixedly provided in the main unit case 21. When the intermediate transfer belt unit 70 is retreated from the opposed position to the opened position, only the intermediate transfer belt unit 70 is displaced and the waste toner boxes 130 remains fixed in the main unit case 21.

With such a configuration, as compared to the configuration in which waste toner boxes are provided integrally with the intermediate transfer belt unit, the movable parts (the intermediate transfer belt unit 70 and the front cover 25) can be made smaller, thereby enabling operation with a smaller force and improving operability.

Because the movable parts are small in size, it is ensured that the process units 50 are exposed outside when the intermediate transfer belt unit 70 is retreated from the opposed position to the opened position. Therefore, there is no need to provide an additional mechanism dedicated to exposing the process units 50 and thus, configuration of the whole device becomes simpler

SECOND EMBODIMENT

Figure 7:
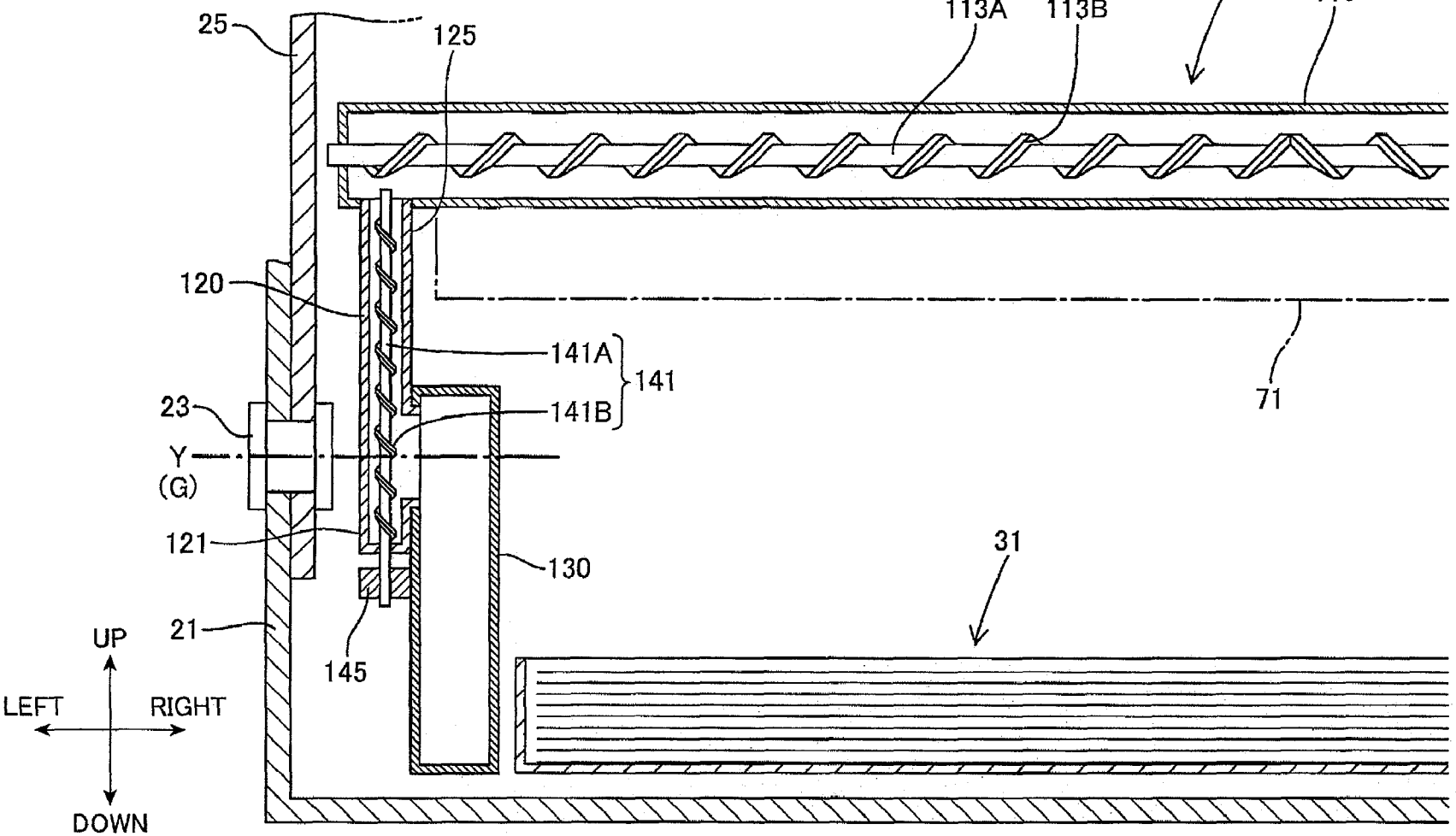
FIG. 7 is a sectional view showing configuration of a duct unit in accordance with a second embodiment.

Next, a second embodiment will be described with reference to FIG. 7.

Configuration of the second embodiment is the same as the configuration of the first embodiment except that an auger 141 is added in each duct unit 120.

The auger 141 has: a shaft 141A extending in the longitudinal direction of the duct unit 120 between its base end 121 and its tip end 125; and a spiral blade 141B formed on the periphery of the shaft 141A. One end of the shaft 141A protrudes from the bottom surface of the duct unit 120 at the base end 121 downward and is supported by a bearing member 145. A driving force of the main motor (not shown) is transmitted to the shaft 141A and the auger 141 is driven to rotate by the driving force. Thus, it is ensured that toner sent into the duct unit 120 is forcibly sent to the waste toner box 130 without remaining in the duct unit 120.

THIRD EMBODIMENT

Figure 8:
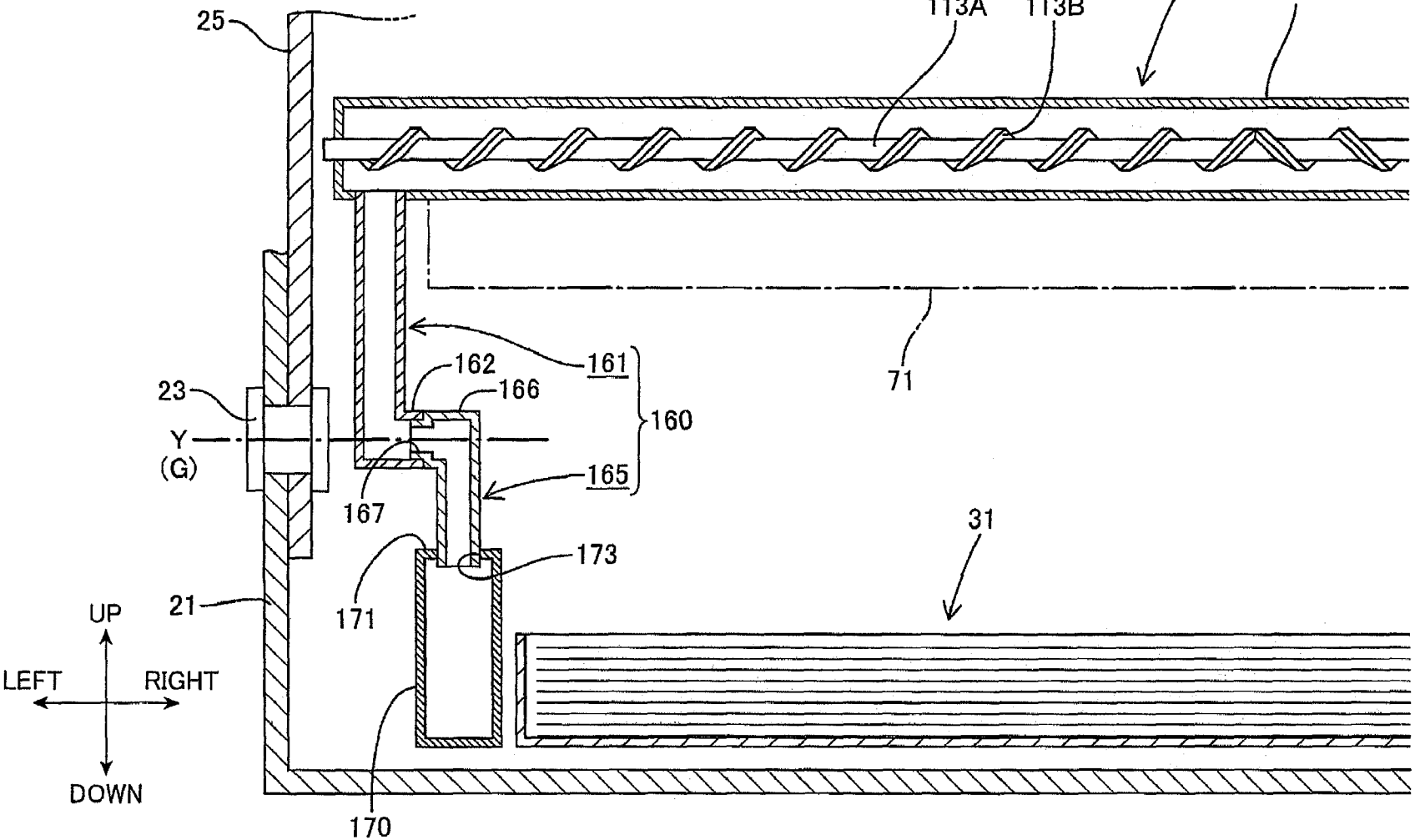
FIG. 8 is a sectional view showing configuration of a duct unit in accordance with a third embodiment.

Next, a third embodiment will be described with reference to FIG. 8.

In the first embodiment, each duct unit 120 is made from a single component and rotates following the opening operation of the front cover 25. In the third embodiment, each duct unit 120 is replaced with a duct unit 160. The duct unit 160 is made from two separate components, only one of which rotates following the opening operation of the front cover 25. Each waste toner box 130 in the first embodiment is replaced with a waste toner box 170.

More specifically, each duct unit 160 is formed of: a cleaning side duct 161 that is connected to the belt cleaning unit 110; and a box side duct 165 that is connected to a corresponding waste toner box 170. The cleaning side duct 161 has a coupling shaft part 162 at its lower end. The box side duct 165 has another coupling shaft part 166 at its upper end. The coupling shaft parts 162 and 166 protrude horizontally and toward each other. The ducts 161 and 165 are connected with each other with their coupling shaft parts 162 and 166 facing each other.

An annular engaging protrusion 167 is provided at the tip end of the coupling shaft part 166 on the box side duct 165. The annular engaging protrusion 167 is engaged with the inner peripheral surface of the coupling shaft part 162 of the cleaning side duct 161 with no gaps therebetween. Thus, the cleaning side duct 161 can rotate relative to the box side duct 165 with the outer peripheral surface of the annular engaging protrusion 167 being in sliding contact with the inner peripheral surface of the coupling shaft part 162.

The central axes of the coupling shaft parts 162 and 166 are aligned with the rotational axis Y of the front cover 25, that is, the rotational axis of the hinge 23. Accordingly, when the front cover 25 is opened, the cleaning side duct 161 rotates around the annular engaging protrusion 167, with the central axes of the coupling shaft parts 162 and 166 serving as the rotational axis G of the cleaning side duct 161. Thus, when the intermediate transfer belt unit 70 is retreated from the opposed state to the opened state, the connection between the belt cleaning unit 110 and the waste toner boxes 170 is maintained. Therefore, the advantages the same as those in the first embodiment can be obtained.

In this embodiment, a toner receiving port 173 is provided on a ceiling wall 171 of each waste toner box 170. Accordingly, when toner conveyed by the duct unit 160 reaches the upper portion of the waste toner box 170, the toner drops due to its own weight to be stored in the waste toner box 170.

FOURTH EMBODIMENT

Next, a fourth embodiment will be described with reference to FIG. 9.

In the first embodiment, the rotational axis G of the duct units 120 is in alignment with the rotational axis Y of the front cover 25, thereby ensuring that the duct units 120 can rotate following the opening operation of the front cover 25. However, in the fourth embodiment, each duct unit 120 is replaced with a duct unit 180 whose rotational axis G is out of alignment with the rotational axis Y of the front cover 25. The duct unit 180 has an extension displacement part 187.

Figure 9:
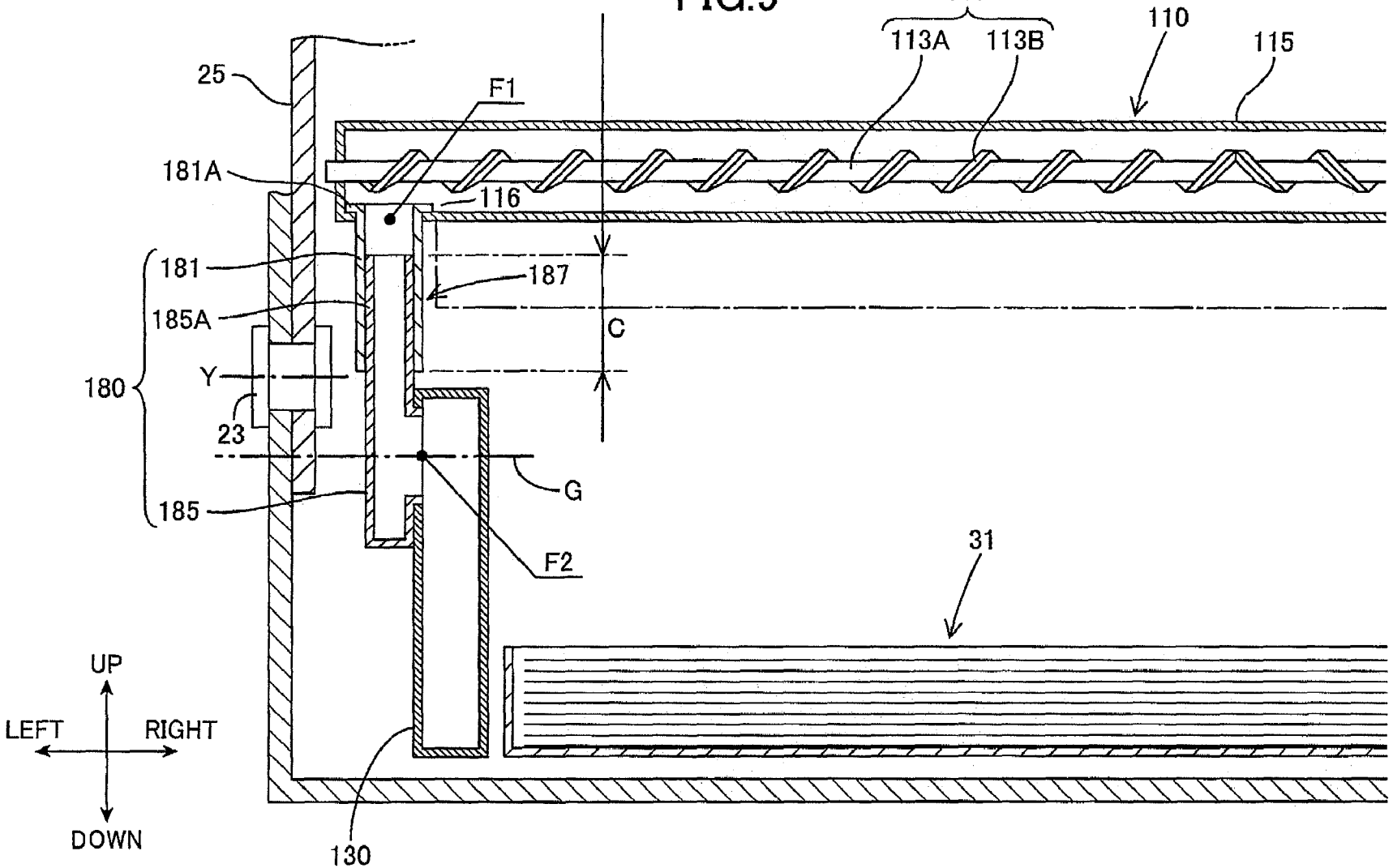
FIG. 9 is a sectional view showing configuration of a duct unit in accordance with a fourth embodiment.

As shown in FIG. 9, the duct unit 180 is formed from a cleaning side duct 181 and a box side duct 185. Both the ducts 181 and 185 are substantially cylindrical in shape. The cleaning side duct 181 has a slightly larger diameter than the box side duct 185. An upper tip end 185A of the box side duct 185 is fitted inside the cleaning side duct 181 with no gaps therebetween. The box side duct 185 is rotatably connected to the waste toner box 130. The box side duct 185 is rotatable relative to the waste toner box 130 around its rotational axis G that is out of alignment with the rotational axis Y of the front cover 25. The cleaning side duct 181 is connected to the belt cleaning unit 110. More specifically, a flange 181A is formed on the upper end of the cleaning side duct 181. The outer diameter of the flange 181A is greater than that of the connecting through-hole 116 formed in the cleaning box 115. The upper end of the cleaning side duct 181 is inserted in the connecting through-hole 116 of the cleaning box 115, with the flange 181A being located inside the cleaning box 115. This configuration prevents the cleaning side duct 181 from being disconnected from the belt cleaning unit 110. As shown in FIG. 9, the box side duct 185 overlaps the cleaning side duct 181 with a length C. The overlapping part between the box side duct 185 and the cleaning side duct 181 is defined as the extension displacement part 187.

The whole length of the duct unit 180 varies when the length C of the overlapping part 181 changes. More specifically, the whole length of the duct unit 180 increases when the length C of the overlapping part 181 decreases. On the contrary, the whole length of the duct unit 180 decreases when the length C of the overlapping part 181 increases.

A connecting point F1 is defined as a connecting point of the duct unit 180 with the belt cleaning unit 110, and a connecting point F2 is defined as a connecting point of the duct unit 180 with the waste toner box 130. Because the rotational axis G of the duct unit 180 is out of alignment with the rotational axis Y of the front cover 25, when the front cover 25 is opened or closed, the duct unit 180 also rotates around its rotational axis G while changing the whole length of the duct unit 180, that is, while changing the distance between the connecting points F1 and F2. Accordingly, when the intermediate transfer belt unit 70 retreats from the opposed position to the opened position, the connection between the belt cleaning unit 110 and the waste toner boxes 130 is maintained. Therefore, the same advantages as those in the first embodiment can be obtained.

FIFTH EMBODIMENT

Next, a fifth embodiment of the invention will be described with reference to FIG. 10 and FIG. 11.

The fifth embodiment is a modification of the third embodiment. The fifth embodiment is different from the third embodiment in that the waste toner box 170 is replaced with a waste toner box 190 which partially extends to the space above the feeding cassette 31 and in that an oscillating unit 32 is additionally provided between the waste toner box 190 and the feeding cassette 31.

Figure 10:
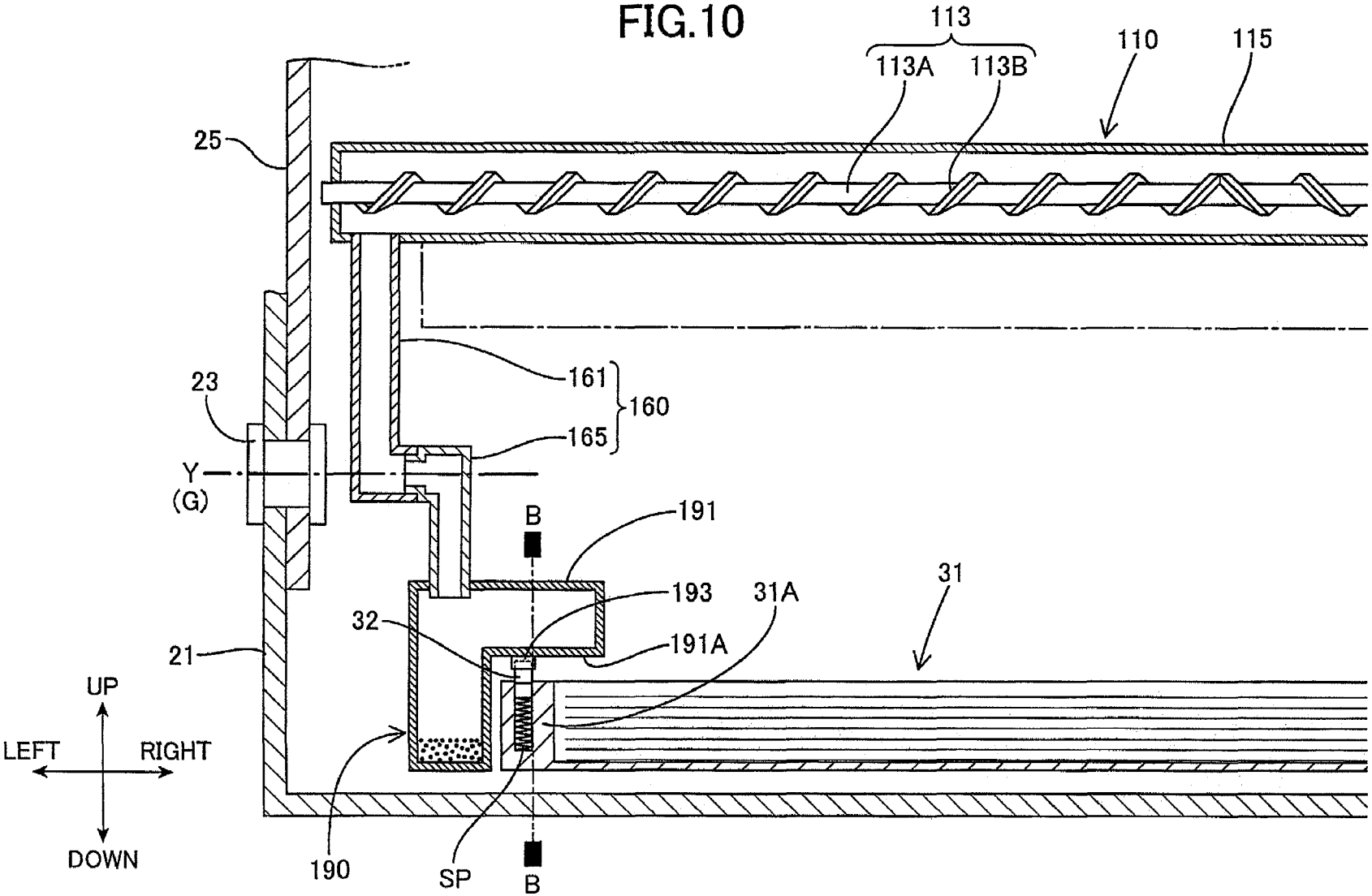
FIG. 10 is a sectional view showing configuration of a waste toner box in accordance with a fifth embodiment.
Figure 11:
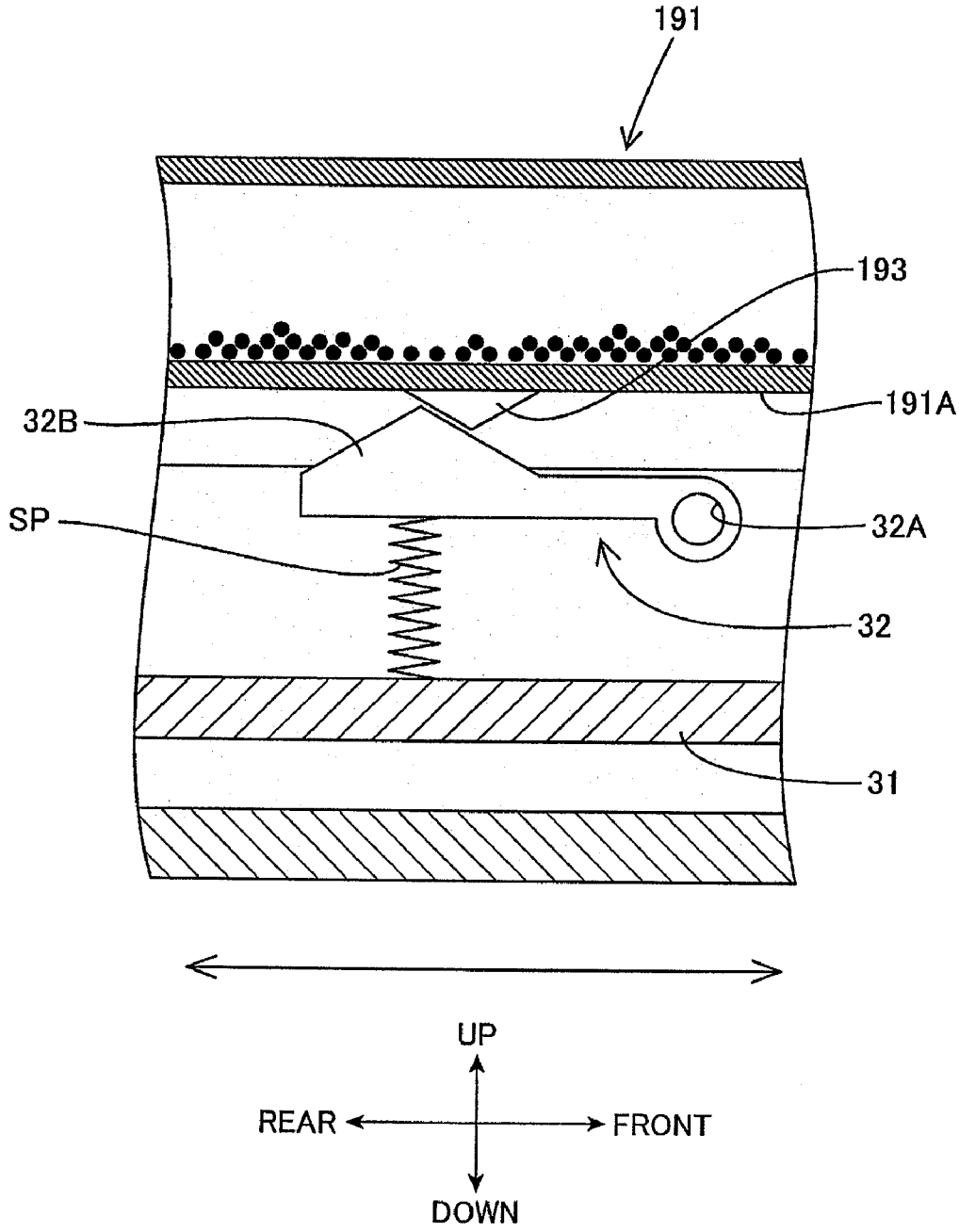
FIG. 11 is a side sectional view taken along a line B-B in FIG. 10.

As shown in FIG. 10, the waste toner box 190 has a swelling part 191 in its upper portion. The swelling part 191 protrudes horizontally in the widthwise direction (right-to-left direction) so as to overlap the feeding cassette 31 in the vertical direction. With such a configuration, storage capacity of the waste toner box 190 is increased without increasing the size of the whole device S.

A spring SP and the oscillating unit 32 are provided at each of the right-side and left-side edges 31A of the feeding cassette 31. In FIG. 10, only the left-side edge 31A of the feeding cassette 31 is shown. The oscillating unit 32 is urged by the spring SP vertically upwardly. As shown in FIG. 11, the oscillating unit 32 has an arm shape extending along the front-to-rear direction, that is, the direction of inserting and detaching the feeding cassette 31 to and from the main unit case 21. The oscillating unit 32 has a hinge 32A at its front end and an upwardly-protruding part 32B at its rear end. The oscillating unit 32 is coupled to the feeding cassette 31 at its front end by the hinge 32A. The upwardly-protruding part 32B protrudes vertically upwardly.

A receiving part 193 is provided on a lower wall 191A of the swelling part 191 at a position opposed to the oscillating unit 32. The receiving part 193 is in the form of a downwardly-protruding portion, When the feeding cassette 31 is attached to or detached from the main unit case 21, the upwardly-protruding part 32B located at the tip end of the oscillating unit 32 rises or lowers along the receiving part 193, thereby applying vibration to the waste toner box 190, and to the whole cleaning mechanism accordingly.

Thus, even when toner scraped off by the scraping blade 111 remains at a certain position in the cleaning mechanism, the toner moves due to vibration. With such a configuration, it is possible to prevent toner from remaining at a certain position, for example, in the duct unit 160.

While the invention has been described in detail with reference to the above aspects thereof, it would be apparent to those skilled in the art that various changes and modifications may be made therein without departing from the spirit of the invention.

In the above-described embodiments, the laser printer S is of the intermediate transfer tandem type, and the belt cleaning unit 110 is provided for cleaning the intermediate transfer belt 71, However, the transfer method is not limited to the intermediate transfer method.

Figure 12:
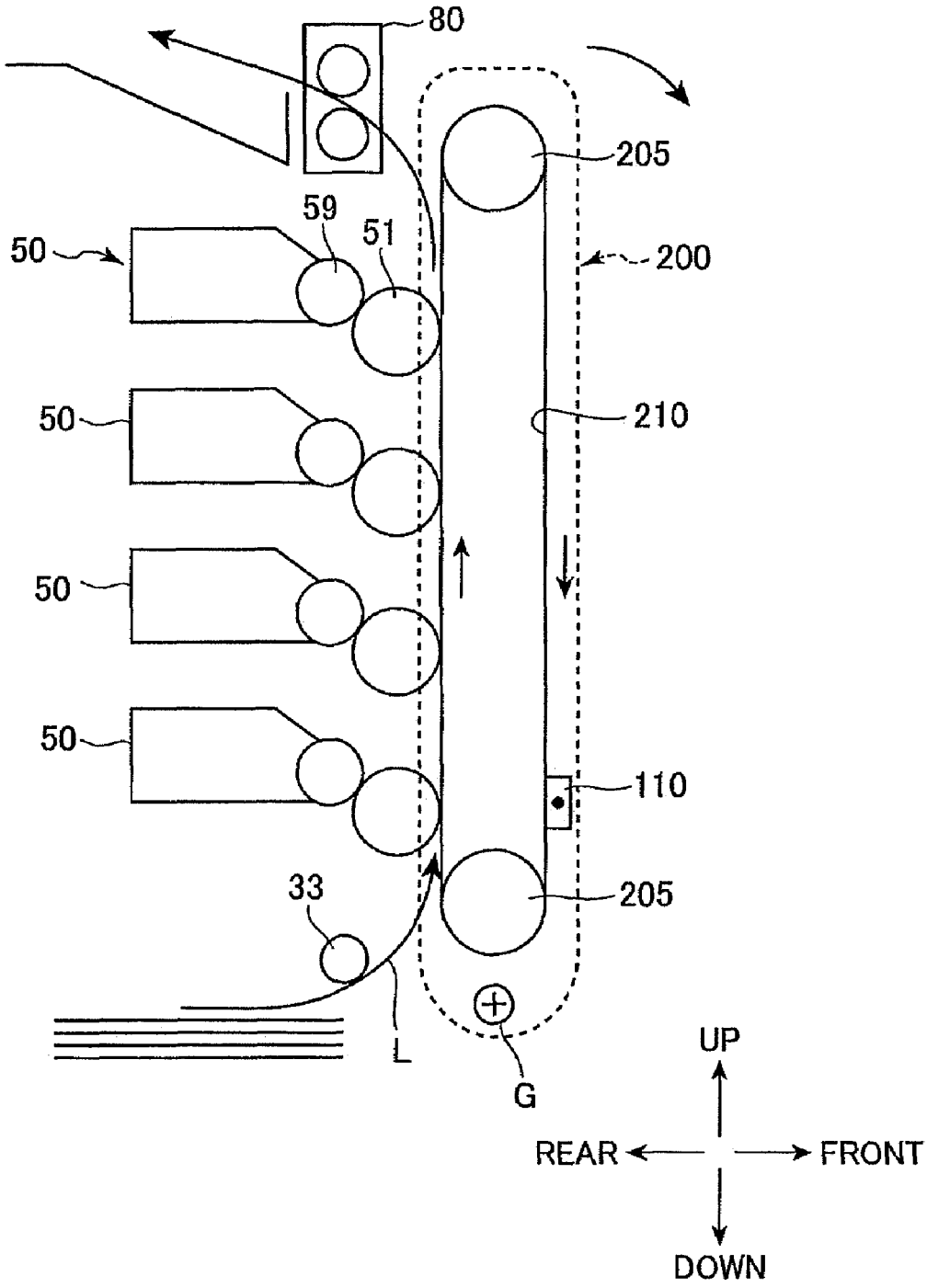
FIG. 12 is a schematic view of a direct tandem type image forming device according to a modification.

For example, the intermediate transfer tandem type laser printer S may be modified to a direct tandem type, as shown in FIG. 12, by replacing the intermediate transfer belt unit 70 with a sheet conveying belt unit 200. The sheet conveying belt unit 200 includes a pair of rollers 205 (drive roller and follow roller) and an endless sheet conveying belt 210 wound around the pair of rollers 205. The belt cleaning unit 110 is fixedly attached to the sheet conveying belt unit 200. The belt cleaning unit 110 is in fluid communication with waste toner boxes (not shown) via duct units (not shown) in the same manner as in either one of the first through fifth embodiments. The sheet conveying belt unit 200 and the belt cleaning unit 110 are held by the front cover 25 (not shown). When the front cover 25 is closed, the sheet conveying belt unit 200 is opposed to the process units 50 as shown in the figure. When the front cover 25 is opened, the sheet conveying belt unit 200 together with the belt cleaning unit 110 rotates. At this time, the duct units rotate around their rotational axis G. This maintains connection between the belt cleaning unit 110 and the waste toner boxes.

Figure 13:
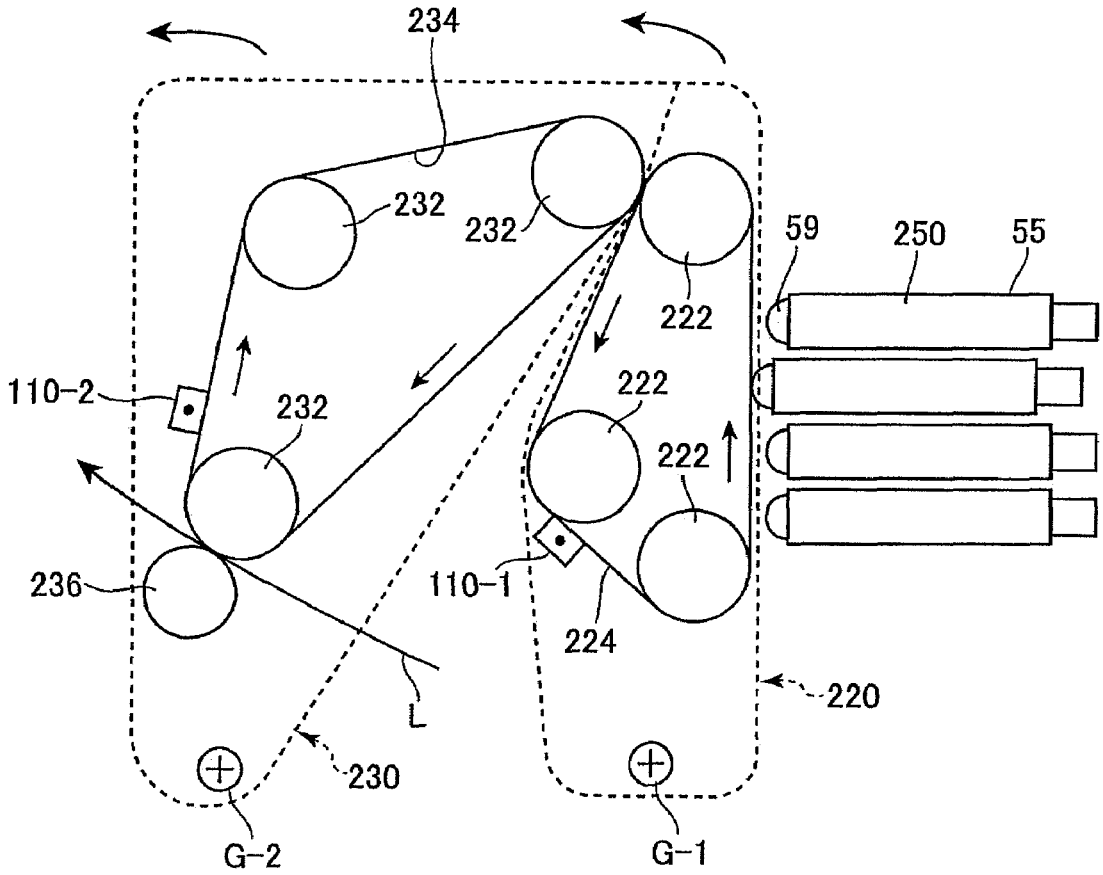
FIG. 13 is a schematic view of a four-cycle type image forming device according to another modification.

Similarly, the intermediate transfer tandem type laser printer S may be modified to a four-cycle type, as shown in FIG. 13, by replacing the intermediate transfer belt unit 70 with a photosensitive belt unit 220 and an intermediate transfer belt unit 230 and by replacing the process units 50 with process units 250.

The photosensitive belt unit 220 includes three rollers 222 (drive roller and follow rollers) and an endless photosensitive belt 224 wound around the rollers 222. A first belt cleaning unit 110-1, which has the same configuration with the belt cleaning unit 110 in the first embodiment, is fixedly attached to the photosensitive belt unit 220. The first belt cleaning unit 110-1 is in fluid communication with waste toner boxes (not shown) via duct units (not shown) in the same manner as in either one of the first through fifth embodiments. The photosensitive belt unit 220 and the first belt cleaning unit 110-1 are held by the front cover 25 (not shown).

The intermediate transfer belt unit 230 includes three rollers 232 (drive roller and follow rollers) and an endless intermediate transfer belt 234 wound around the rollers 232. A second belt cleaning unit 110-2, which has the same configuration with the belt cleaning unit 110 in the first embodiment, is fixedly attached to the intermediate transfer belt unit 230. A transfer roller 236 is additionally provided in the intermediate transfer belt unit 230. The second belt cleaning unit 110-2 is in fluid communication with waste toner boxes (not shown) via duct units (not shown) in the same manner as in either one of the first through fifth embodiments. The intermediate transfer belt unit 230 and the second belt cleaning unit 110-2 are held also by the front cover 25 (not shown).

The process units 250 are the same as the process units 50 in the first embodiment except that the process units 250 have no photosensitive drums 51 and that the process units 250 can individually move in the front-to-rear direction to bring the developing rollers 59 into and out of contact with the photosensitive belt 224 individually.

When the front cover 25 is closed, the photosensitive belt unit 220 and the intermediate transfer belt unit 230 are opposed to the process units 250 as shown in the figure. When the front cover 25 is opened, the photosensitive belt unit 220 together with the first belt cleaning unit 110-1 rotates and the intermediate transfer belt unit 230 together with the second belt cleaning unit 110-2 rotates. At this time, the duct units for the first belt cleaning unit 110-1 rotate around their rotational axis G-1 and the duct units for the second belt cleaning unit 110-2 rotate around their rotational axis G-2. This maintains connection between the belt cleaning units 110-1 and 110-2 and their waste toner boxes.

It is noted that in the above description, both of the photosensitive belt unit 220 and the intermediate transfer belt unit 230 are configured to be capable of rotating together with the front cover 25. However, only one of the photosensitive belt unit 220 and the intermediate transfer belt unit 230 may be configured to be capable of rotating together with the front cover 25.

In the above-described fifth embodiment, the oscillating unit 32 is oriented with the upwardly-protruding part 32B in the rear end of the oscillating unit 32 and the hinge 32A in the front end. However, the oscillating unit 32 may be oriented with the hinge 32A in the rear end of the oscillating unit 32 and the upwardly-protruding part 32B in the front end.

What is claimed is:

1. An image forming device comprising:

a main unit case;

a process unit which is configured to be attached to and detached from the main unit case;

a belt unit which is configured to displace between an opposed position and an opened position, the belt unit in the opposed position being opposed to the process unit, the belt unit in the opened position allowing the process unit to be exposed in the direction of removing the process unit from the main unit case;

a belt which is provided on the belt unit and which is rotatingly driven;

a belt cleaning unit which is fixedly attached to the belt unit and which removes material adhered to the belt;

a storing unit which is fixedly attached to the main unit case and which stores therein the material removed from the belt by the belt cleaning unit; and a duct unit which has a conveying path in fluid communication with the belt cleaning unit and the storing unit, and which conveys, along the conveying path, the material removed by the belt cleaning unit from the belt cleaning unit to the storing unit.

2. The image forming device as claimed in claim 1, further comprising a cover rotating around its rotational axis to open and close a removing port formed in one side of the main unit case, wherein the belt unit is fixedly mounted on the cover, the belt unit and the belt cleaning unit rotating together with the cover around the rotational axis to displace from the opposed position to the opened position, and at least a part of the duct unit is configured to rotate around the rotational axis of the cover when the belt cleaning unit rotates around the rotational axis.

3. The image forming device as claimed in claim 2, wherein the storing unit has a receiving port receiving the material removed from the belt, the receiving port being provided on the rotational axis of the cover, and an end of the duct unit is rotatably fitted to the receiving port.

4. The image forming device as claimed in claim 1, wherein the duct unit includes an extension displacement part whose length varies in association with the displacing operation of the belt unit.

5. The image forming device as claimed in claim 1, wherein the duct unit includes an auger in the conveying path, the auger conveying, from the belt cleaning unit to the storing unit, the material removed by the belt cleaning unit.

6. The image forming device as claimed in claim 1, further comprising a feeding cassette which stores recording media therein, the feeding cassette and the storing unit being arranged next to each other in a width direction of the main unit case, the width direction being orthogonal to the direction of removing the process unit.

* * * * *